US012145027B1

(12) United States Patent
Kim

(10) Patent No.: US 12,145,027 B1
(45) Date of Patent: Nov. 19, 2024

(54) SPORTS BALL, BAT, AND ASSOCIATED METHODS

(71) Applicant: Aaron J. Kim, East Islip, NY (US)

(72) Inventor: Aaron J. Kim, East Islip, NY (US)

( * ) Notice: Subject to any disclaimer, the term of this patent is extended or adjusted under 35 U.S.C. 154(b) by 0 days.

(21) Appl. No.: 17/892,230

(22) Filed: Aug. 22, 2022

Related U.S. Application Data

(63) Continuation of application No. 17/325,803, filed on May 20, 2021, now abandoned, which is a continuation of application No. 15/792,177, filed on Oct. 24, 2017, now abandoned, which is a continuation of application No. 14/824,748, filed on (Continued)

(51) Int. Cl.

| | |
|---|---|
| ***A63B 39/00*** | (2006.01) |
| ***A63B 43/00*** | (2006.01) |
| ***A63B 59/50*** | (2015.01) |
| ***A63B 59/54*** | (2015.01) |
| ***A63B 69/00*** | (2006.01) |
| *A63B 60/00* | (2015.01) |

(Continued)

(52) U.S. Cl.
CPC ..... *A63B 39/00* (2013.01); *A63B 43/002* (2013.01); *A63B 59/50* (2015.10); *A63B 59/54* (2015.10); *A63B 69/0002* (2013.01); *A63B 2039/003* (2013.01); *A63B 2043/001* (2013.01); *A63B 60/004* (2020.08); *A63B 60/54* (2015.10); *A63B 2102/18* (2015.10); *A63B 2225/01* (2013.01)

(58) Field of Classification Search
CPC . A63B 39/00; A63B 2039/003; A63B 43/002; A63B 43/00
USPC ..... D21/717
See application file for complete search history.

(56) References Cited

U.S. PATENT DOCUMENTS 805,132 A 11/1905 Gubbins
917,658 A 4/1909 Reach
(Continued)

FOREIGN PATENT DOCUMENTS

CN 102319508 A * 1/2012
CN 102772892 A * 11/2012
(Continued)

OTHER PUBLICATIONS

"Wikipedia: Riseball", <https://en.wkipedia.org/wiki/Riseball>, retrieved on May 31, 2024, dated Jun. 22, 2004. (Year: 2004).*
(Continued)

*Primary Examiner* — Steven B Wong
(74) *Attorney, Agent, or Firm* — Allen, Dyer, Doppelt + Gilchrist, PA

(57) ABSTRACT

A sports ball for use in baseball-type games includes a hollow, substantially spherical plastic ball that has a plurality of substantially planar, intersecting regions covering an outer surface thereof. Preferably the ball also has a weight that is substantially less than a weight of a regulation baseball, for enhancing safety in use. The sports system further includes a bat for use with the ball, or with any similar ball, preferably a plastic ball. The bat is a hollow, elongated member that has a handle portion adjacent a bottom end and a barrel portion between the handle portion and a top end. The bat further has a sheath surrounding at least a portion of the barrel portion. The sheath has a coefficient of friction higher than a coefficient of friction of a surface of the barrel portion, for imparting "traction" to a struck ball.

5 Claims, 6 Drawing Sheets

Related U.S. Application Data

Aug. 12, 2015, now abandoned, which is a continuation of application No. 12/869,142, filed on Aug. 26, 2010, now abandoned, which is a continuation-in-part of application No. 11/189,331, filed on Jul. 26, 2005, now abandoned.

(60) Provisional application No. 60/599,180, filed on Aug. 5, 2004.

(51) Int. Cl.
*A63B 60/54* (2015.01)
*A63B 102/18* (2015.01)

(56) References Cited

U.S. PATENT DOCUMENTS

| | | | | |
|---|---|---|---|---|
| 1,299,092 | A | | 4/1919 | Abrahamson |
| 1,477,255 | A | | 12/1923 | Fritz |
| 2,258,174 | A | | 10/1941 | Chawner |
| 2,760,775 | A | | 8/1956 | Tipton |
| 2,791,868 | A | | 5/1957 | Viken |
| 2,967,710 | A | | 1/1961 | Carlson |
| 3,040,384 | A | | 6/1962 | Whittington |
| 3,079,644 | A | | 3/1963 | Molitor et al. |
| 3,195,895 | A | | 7/1965 | Kropinski |
| 3,811,677 | A | | 5/1974 | Saladrigas |
| 3,887,183 | A | | 6/1975 | Saso |
| 3,899,838 | A | | 8/1975 | Lalley |
| 3,931,971 | A | | 1/1976 | Harvey |
| 3,959,893 | A | | 6/1976 | Sigg |
| 4,003,573 | A | | 1/1977 | Craig, Jr. |
| 4,070,434 | A | | 1/1978 | Noda |
| 4,128,238 | A | | 12/1978 | Newcomb |
| 4,154,789 | A | | 5/1979 | Delacoste |
| 4,256,304 | A | | 3/1981 | Smith et al. |
| 4,286,783 | A | | 9/1981 | Newcomb et al. |
| 4,498,667 | A | | 2/1985 | Tomar |
| 4,522,396 | A | | 6/1985 | Girard et al. |
| 4,546,978 | A | | 10/1985 | David |
| 4,610,071 | A | | 9/1986 | Miller |
| D288,461 | S | | 2/1987 | Hira |
| D288,462 | S | | 2/1987 | Hira |
| D290,428 | S | * | 6/1987 | Johnson ..... D25/13 |
| 4,679,361 | A | | 7/1987 | Yacoe |
| 4,735,419 | A | | 4/1988 | Koca |
| 4,763,900 | A | | 8/1988 | Carr |
| 4,830,378 | A | | 5/1989 | Aoyama |
| 4,836,787 | A | | 6/1989 | Boo |
| 4,919,422 | A | | 4/1990 | Ma |
| 4,956,234 | A | | 9/1990 | Morales |
| 5,104,125 | A | | 4/1992 | Wilson |
| 5,123,659 | A | | 6/1992 | Williams |
| 5,224,710 | A | | 7/1993 | Feokhari |
| 5,236,196 | A | | 8/1993 | Blackenburg et al. |
| D359,327 | S | * | 6/1995 | Gould ..... D21/468 |
| 5,562,552 | A | | 10/1996 | Thurman |
| 5,571,019 | A | | 11/1996 | Wilson |
| 5,588,648 | A | | 12/1996 | Stebbins |
| D382,003 | S | | 8/1997 | Moriyama et al. |
| 5,688,193 | A | | 11/1997 | Kasasima et al. |
| 5,700,211 | A | | 12/1997 | Mackie |
| 5,911,639 | A | | 6/1999 | Kasashima et al. |
| 5,918,881 | A | | 7/1999 | Kirby |
| 5,947,741 | A | | 9/1999 | Villareal |
| 6,012,997 | A | | 1/2000 | Mason |
| 6,106,017 | A | | 8/2000 | Johnson |
| D440,265 | S | | 4/2001 | Cannon |
| D444,829 | S | | 7/2001 | Ota |
| 6,261,197 | B1 | | 7/2001 | Grechko |
| 6,319,157 | B1 | | 11/2001 | Broadbent |
| 6,432,008 | B1 | | 8/2002 | Lemmon |
| 6,612,942 | B1 | | 9/2003 | Battersby et al. |
| D485,420 | S | | 1/2004 | Cannon |
| 6,729,984 | B2 | | 5/2004 | Silverglate |
| 6,837,814 | B2 | | 1/2005 | Thomas |
| 7,608,003 | B1 | | 10/2009 | Fusco |
| D782,753 | S | * | 3/2017 | Eisenbarth ..... D21/713 |
| D787,519 | S | * | 5/2017 | Nolan ..... D14/440 |
| 10,543,421 | B1 | * | 1/2020 | Smith ..... A63F 9/0826 |
| 2003/0158002 | A1 | | 8/2003 | Morgan et al. |
| 2003/0226300 | A1 | | 12/2003 | Ootsuka |
| 2004/0058752 | A1 | | 3/2004 | Kasashima |
| 2004/0162171 | A1 | | 8/2004 | Silverglate |
| 2006/0217220 | A1 | | 9/2006 | Davignon, III |
| 2008/0197566 | A1 | * | 8/2008 | Lee ..... A63F 9/1208 273/157 R |
| 2009/0325745 | A1 | * | 12/2009 | Rapaport ..... B32B 27/08 473/604 |
| 2015/0314909 | A1 | * | 11/2015 | Vergés Escuín ..... F21V 1/12 229/110 |
| 2022/0319286 | A1 | * | 10/2022 | Pinckney ..... G08B 5/38 |

FOREIGN PATENT DOCUMENTS

| | | | | | |
|---|---|---|---|---|---|
| DE | 10043521 | A1 | * | 11/2001 | ..... A63B 39/06 |
| GB | 2347089 | A | * | 8/2000 | ..... A63F 9/12 |
| JP | H065700 | U | * | 1/1994 | |
| JP | H08155137 | A | * | 6/1996 | |
| JP | H10166800 | A | * | 6/1998 | |
| KR | 20070119194 | A | * | 12/2007 | |

OTHER PUBLICATIONS

"Aggie Academy-Rise Ball", <https://www.youtube.com/watch?v_3YLto8gKzBo&t=59s>, retrieved on May 31, 2024, dated Mar. 31, 2009. (Year: 2009).*

* cited by examiner

SPORTS BALL, BAT, AND ASSOCIATED METHODS

CROSS-REFERENCE TO RELATED APPLICATIONS

This application is a continuation of U.S. Non-provisional application Ser. No. 17/325,803, filed on May 20, 2021, which is a continuation of U.S. Non-provisional application Ser. No. 15/792,177, filed on Oct. 24, 2017, which is a continuation of U.S. Non-provisional application Ser. No. 14/824,748, filed on Aug. 12, 2015, which is a continuation of U.S. Non-provisional application Ser. No. 12/869,142, filed on Aug. 26, 2010, which is continuation-in-part of U.S. Non-provisional application Ser. No. 11/189,331, filed on Jul. 26, 2005, which claims priority to U.S. Provisional Application Ser. No. 60/599,180, filed Aug. 5, 2004, the contents of which applications are hereby incorporated by reference in their entirety.

FIELD OF THE INVENTION

The present invention relates to sports balls and bats and methods for constructing same, and, more particularly, to such balls and bats for use in baseball-type games.

BACKGROUND OF THE INVENTION

Regulation baseballs are heavy and potentially dangerous to game participants and to surrounding objects. Plastic balls are known in the art that are hollow and have apertures (e.g., the "Wiffle" ball).

It would be desirable to provide a sports ball that is both safe and yet substantially retains the aerodynamic characteristics of a regulation baseball.

It would also be desirable to provide a bat for use with such a sports ball.

SUMMARY OF THE INVENTION

One aspect of the present invention is directed to a sports system that comprises a ball for use in baseball-type games. The sports ball comprises a hollow, substantially spherical ball that has a plurality of substantially planar, intersecting regions covering an outer surface thereof. Preferably the ball also has a weight that is substantially less than a weight of a regulation baseball, for enhancing safety in use.

Another aspect of the invention is directed to a sports system, which further comprises a bat for use with the ball, or with any similar ball, preferably a plastic ball. The bat comprises a hollow, elongated member that has a handle portion adjacent a bottom end and a barrel portion between the handle portion and a top end. The barrel portion has a surface having a striking sector, the striking sector having a coefficient of friction higher than a coefficient of friction of an adjacent surface sector of the barrel portion, for imparting "traction" to a struck ball.

A brief discussion of a possible explanation for the behavior of the sports ball of the present invention will now follow. It is to be understood that this explanation is not intended as limiting on the structure of the invention.

The sports ball of the present invention has been shown to provide increased speed and distance. It is believed that the intersecting substantially planar regions of the ball help to minimize drag when the ball is in motion by creating "turbulent airflow" that "sticks" to the baseball slightly longer than would be the case for a smooth ball. This in turn creates a smaller air "separation region" behind the ball (air vacuum), which minimizes drag and maximizes speed and distance. This is believed to be similar to the effect of the dimples on golf balls.

The sports ball of the present invention also provides improved curving properties. It is believed that the intersecting regions create natural "ridges" at each intersection line, which makes the ball effective at "deflecting" air to the side when the ball is "spun." The fact that airflow is deflected sideways as the ball is spun and in forward motion means that there is an equal and opposite force acting on the ball that pushes the ball in the other direction (curve).

Generally, a method of playing a baseball game may comprise throwing a plastic baseball. The plastic baseball may include a hollow plastic shell, and an outer surface of the hollow plastic shell comprising a plurality of solid planar surfaces. Each and every one of the plurality of solid planar surfaces may directly adjoin multiple adjacent ones of the plurality of solid planar surfaces. The directly adjoining multiple adjacent ones of the plurality of solid planar surfaces may define a repeating pattern comprising a pentagon-shaped solid planar surface surrounded by hexagon-shaped solid planar surfaces. The outer surface may include a raised seam extending at boundaries between the directly adjoining ones of the plurality of solid planar surfaces, and extending completely across a given boundary segment between two adjoining ones of the plurality of solid planar surfaces and extending completely through at least one adjacent boundary segment between two adjoining ones of the plurality of solid planar surfaces. The throwing of the plastic baseball may include imparting a spin thereto such that the plastic baseball curves during flight, and the plastic baseball may be thrown with spin such that the plastic baseball rises during the flight as a result of the spin.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF PREFERRED EMBODIMENTS

Figure 1:
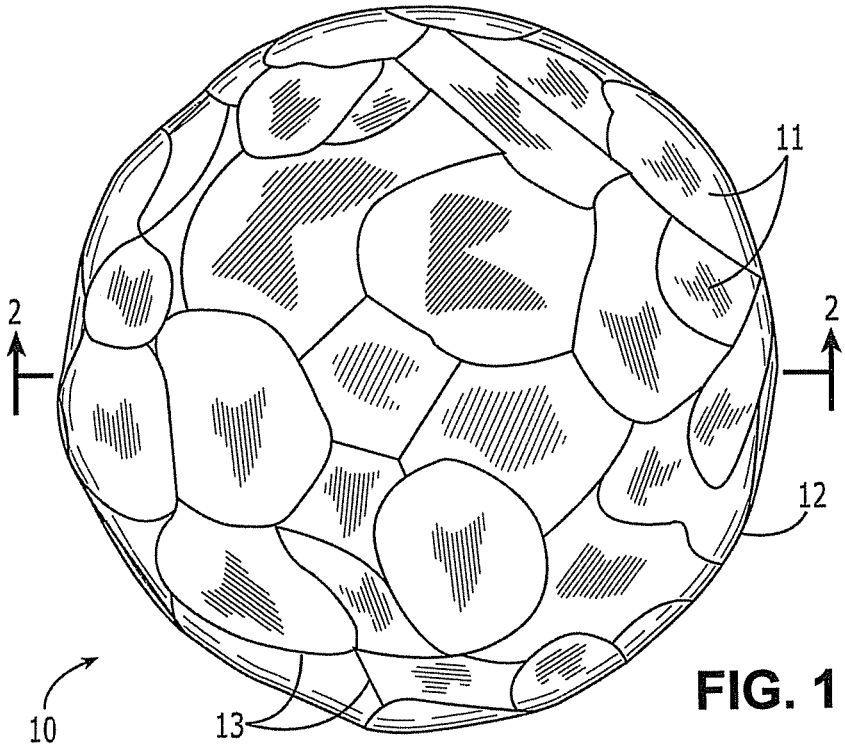
FIG. 1 is a side perspective view of a sports ball, according to an embodiment of the present invention.
Figure 2:
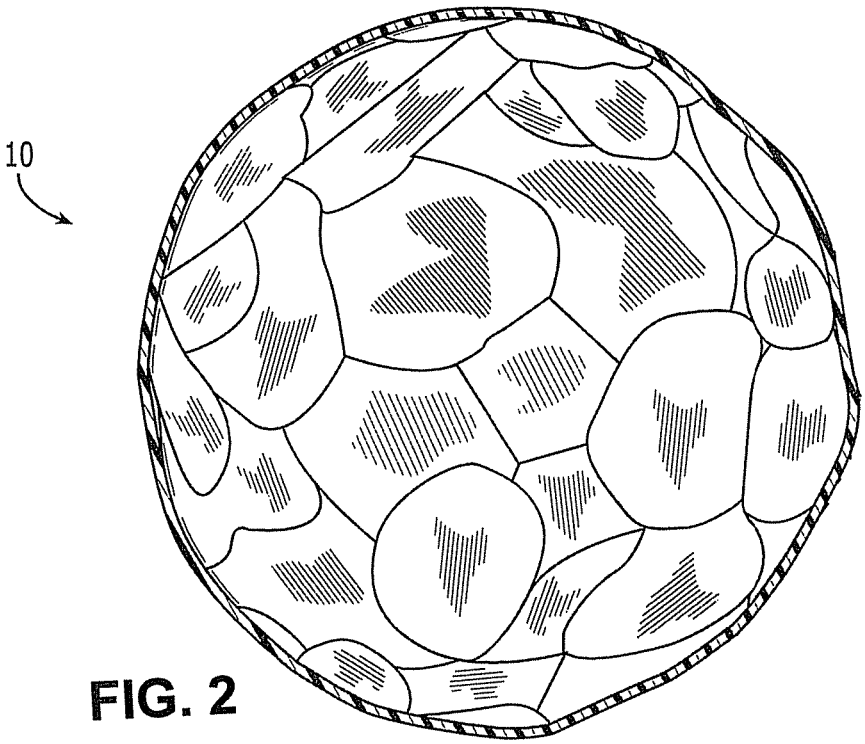
FIG. 2 is a cross-sectional view of the ball of FIG. 1 along line 2-2.

Referring to FIGS. 1 and 2, the present invention is directed to a sports system that comprises a sports ball 10 for use in baseball-type games. The sports ball 10 comprises a hollow, substantially spherical ball. The ball 10 may comprise a plastic material, although this is not intended as a limitation.

The ball 10 has a plurality of substantially planar, intersecting regions 11 covering an outer surface 12 thereof. In some embodiments the regions 11 may be slightly concave or convex without departing from the spirit of the invention. The regions 11 may be either regular or irregular, and do not have to conform to a specific pattern. Also preferably the ball 10 comprises a sufficient number of planar regions 11 to remain substantially spherical, meaning that the ball 10 will still bounce and rebound in a manner similar to a spherical ball, such that the bounce and rebound are predictable upon striking subsequent contact with another surface. Essentially, any difference in the angle of bounce and rebound will be visually imperceptible, with "visually imperceptible" meaning visually imperceptible to the unaided vision of a human watching live in real time.

Through experimentation, it has been found that the ball 10 of the present invention travels faster and farther than similar products, and also curves more. However, the aerodynamic characteristics are closer to those of a regulation baseball than to a Wiffle ball, in that baseball spins can be imparted. Since the ball 10 is lighter, safety is enhanced, and also the ball 10 curves much more than a regulation baseball without having to be thrown as hard. In fact, with sufficient backspin, the ball 10 can rise in flight.

Another advantage is that the planar regions 11 allow for a better grip, also enhancing the amount of spin that can be imparted. Preferably the ball 10 also has a weight that is substantially less than a weight of a regulation baseball, for enhancing safety in use.

Figure 3:
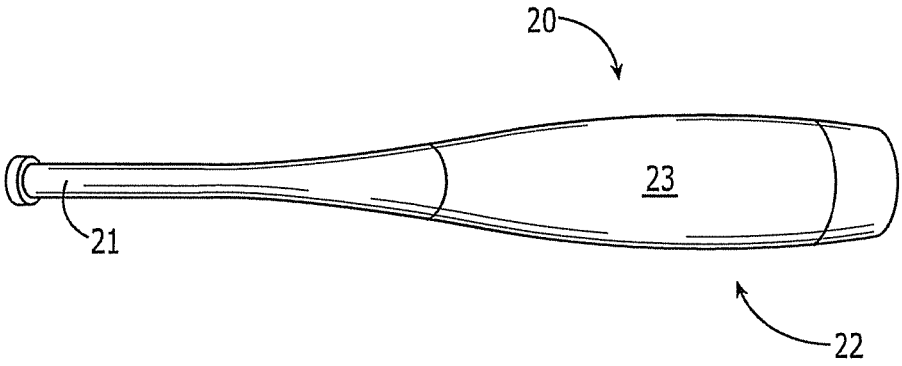
FIG. 3 is a side perspective view of a bat for use with the ball of FIGS. 1 and 2.

Referring to FIG. 3, the sports system of the present invention further includes a bat 20 for use with the above-described ball 10. The bat 20 comprises an elongated, hollow, lightweight element having a standard "bat" shape, including a handle portion 21 and a "barrel" (hitting) portion 22. In a particular embodiment, at least part of the barrel portion 22 is surrounded by a striking sector comprising a sheath 23 that imparts greater traction to a ball 10 when hit than other known bat surfaces. The sheath 23 has a coefficient of friction greater than an adjacent surface sector 24. Alternately, the striking sector can be built or molded into the bat. In either case, it is preferred that the striking sector 23 have a more resilient surface than the adjacent surface sector 24. In a preferred embodiment, the sheath 23 comprises a rubber material, although this is not intended as a limitation.

The bat 20 of the present invention is usable with other balls besides that 10 of the present invention, and confers cost, safety, and usage advantages over other bats of the prior art. For example, plastic balls travel farther when struck with the bat 20, because of increased backspin created when the ball is properly struck. The hitting surface 23 of the bat 20 provides traction between the ball 10 and the bat 20 and grips the ball 10 at the point of impact to spin the ball at a higher rate than do other known plastic bats. Such backspin created from a properly hit ball creates loft, which carries a ball a greater distance.

In addition, there is a synergy between the ball 10 and the bat 20 of the present invention, wherein the intersections 13 between planar regions 11 can be gripped effectively by the striking sector 23.

Even if a ball is struck in a non-ideal manner, the sheath 23 still grips the ball better, resulting in a more efficient transfer of force between the ball and bat 20. If a typical plastic baseball is not hit at its exact center, a portion of the bat's force is lost on the ball owing to slippage, particularly when a plastic ball is struck by a plastic bat surface, thereby resulting in "lazy" fly balls or weak ground balls. The bat 20 of the present invention, however, preserves some of the force that would otherwise have been lost, and allows the batter to hit the ball harder even if the ball is not struck at an ideal angle.

The bat 20 also delivers a longer ball because of its added weight over known plastic bats. Additionally, the bat 20 of the present invention is advantageous because the striking sector 23 serves to protect the batter's hands by acting as a shock absorber if a ball is not struck in an ideal manner.

Figure 4:
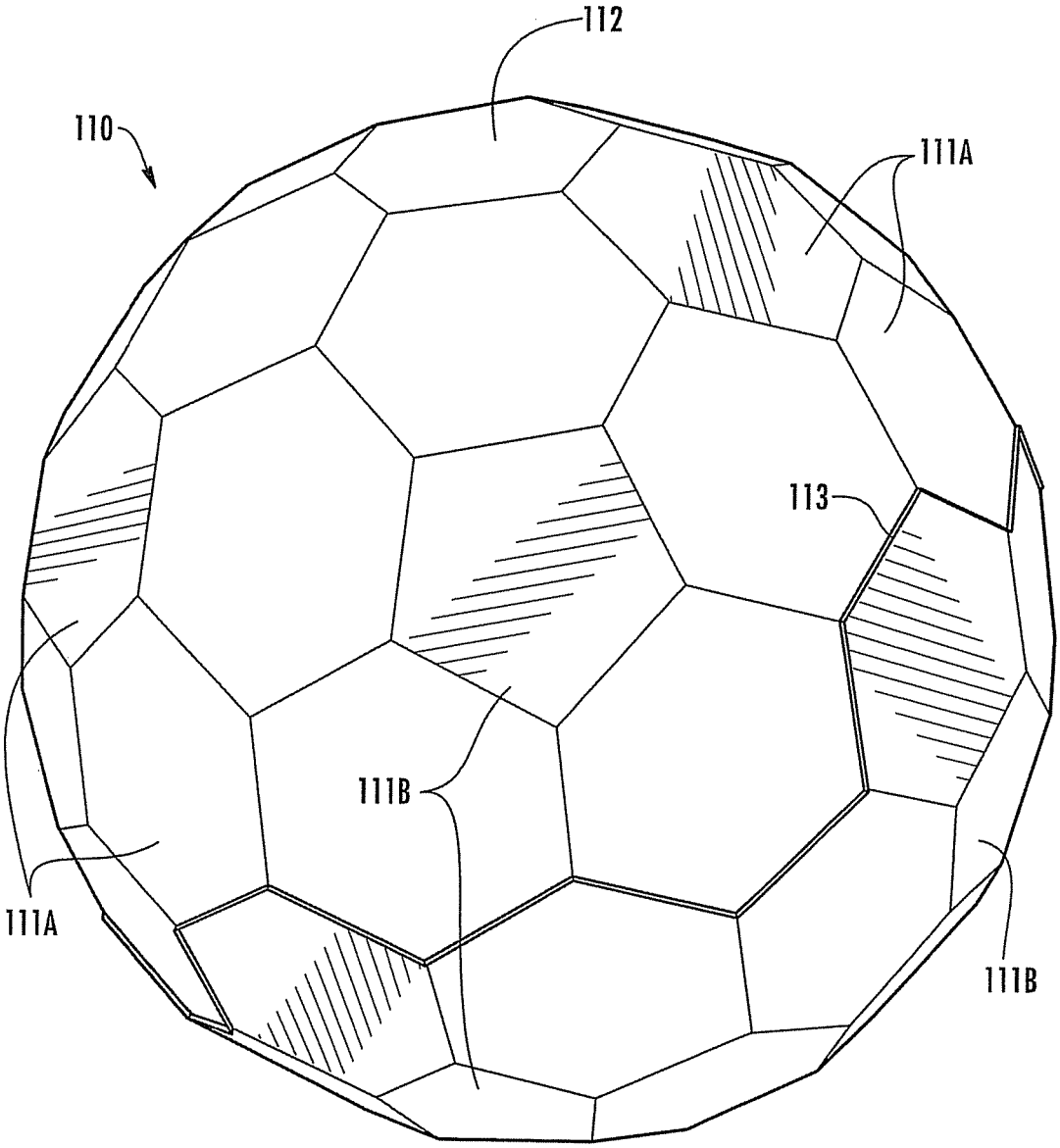
FIG. 4 is a side perspective view of a sports ball, according to another embodiment of the present invention.
Figure 5:
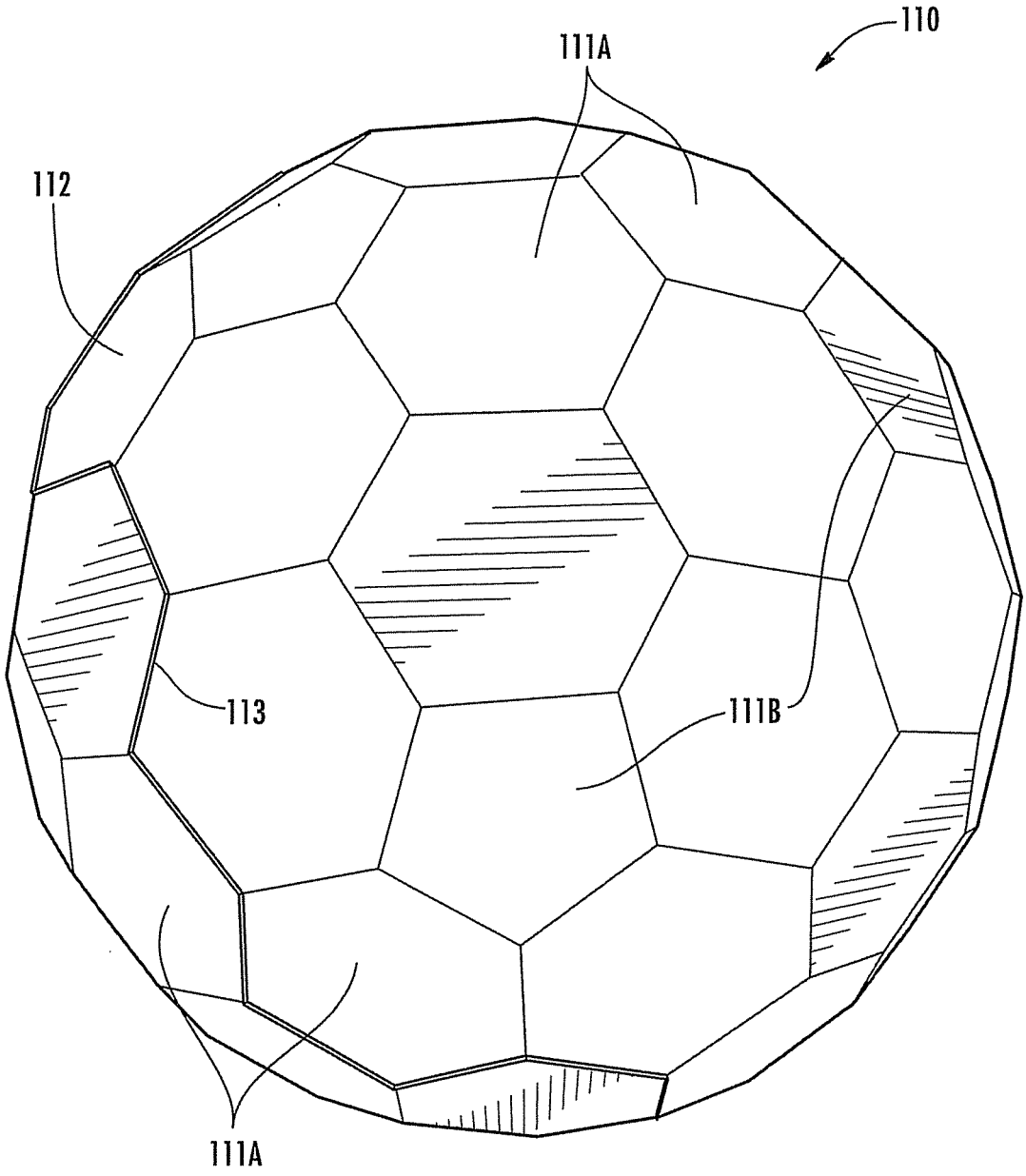
FIG. 5 is an opposite side perspective view of the sports ball of FIG. 4.

Referring to FIGS. 4 and 5, according to another embodiment of the present invention, a ball 110 has a plurality of planar regions 111 forming an outer surface 112 thereof. Preferably, the ball 110, like the ball 10, is substantially hollow. Preferably, there are 72 planar regions 111, including 60 hexagonal regions 111A and 12 pentagonal regions 111B. A raised seam 113 extends generally around a circumference of the ball 110 between borders of a portion of the planar regions 111.

Figure 6:
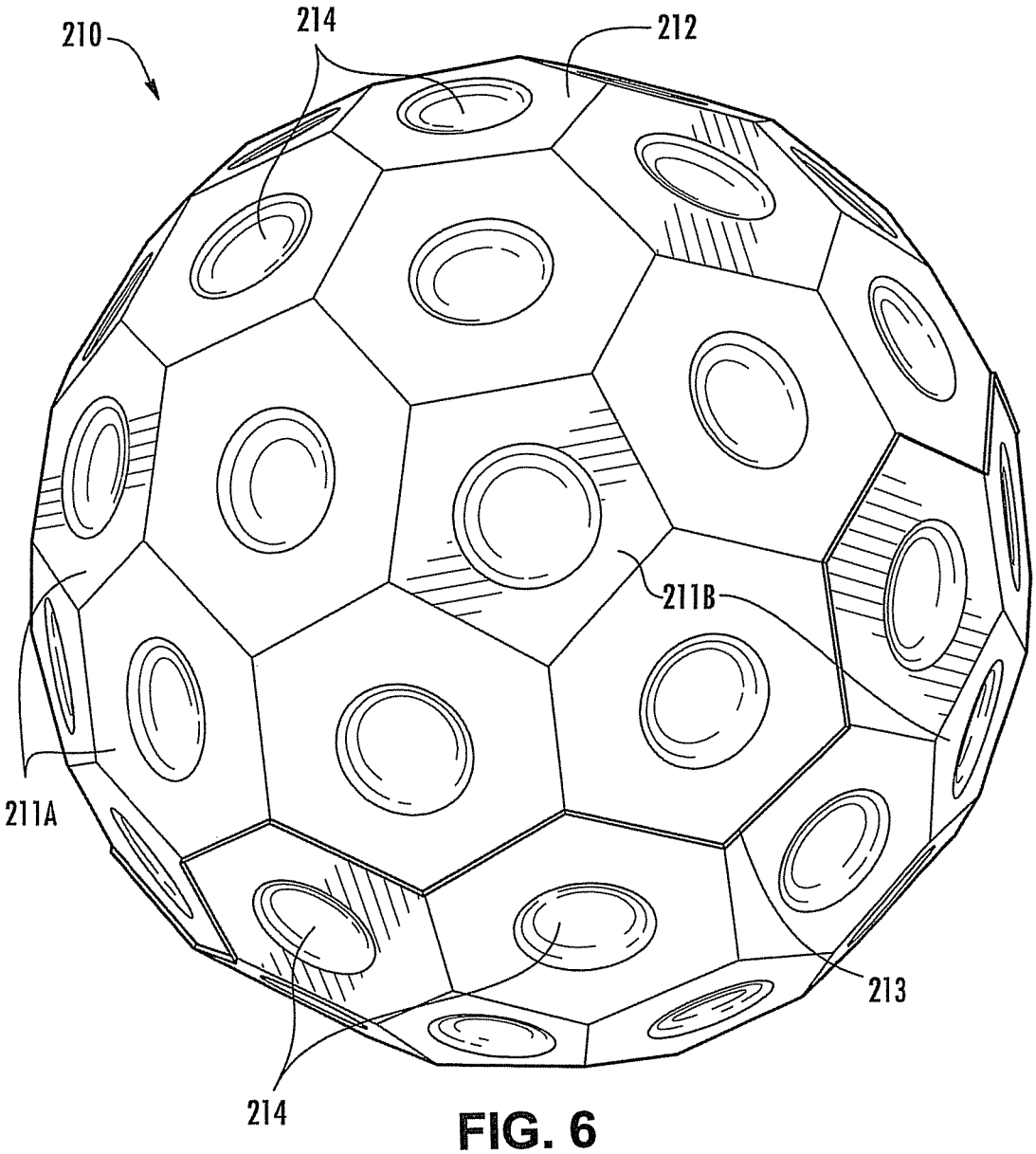
FIG. 6 is a side perspective view of a sports ball, according to a further embodiment of the present invention.

According to a further embodiment of the present invention, referring to FIG. 6, a ball 210 has a plurality of planar regions 211 forming an outer surface 212 thereof. Preferably, the ball 210, like the balls 10 and 110, is substantially hollow. As with the ball 110, there are preferably 72 planar regions 211, including 60 hexagonal regions 211A and 12 pentagonal regions 211B. A raised seam 213 extends generally around a circumference of the ball 210 between borders of a portion of the planar regions 211. A plurality of concave divots 214 are formed in the outer surface 212. Preferably, one divot 214 is generally centered in each of the planar regions 211. The depicted divot 214 is generally circular, although the present invention is not necessarily limited to a particular divot shape.

Figure 7:
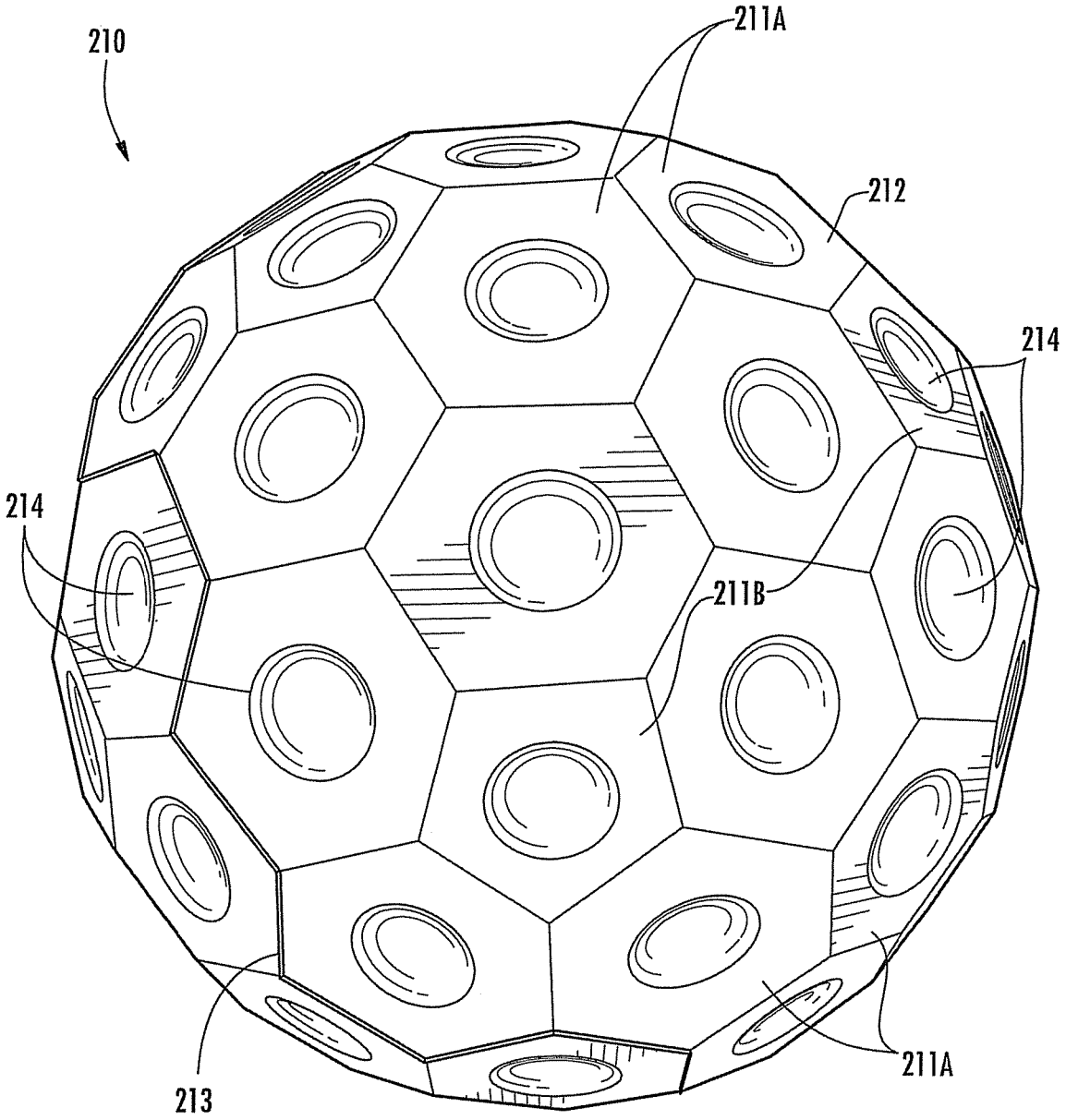
FIG. 7 is a side perspective view of a sports ball, according to an additional embodiment of the present invention.

For instance, according to an additional embodiment of the present invention, referring to FIG. 7, a ball 310 has a plurality of planar regions 311 forming an outer surface 312 thereof. Preferably, the ball 310, like the balls 10, 110, and 210, is substantially hollow. As with the balls 110 and 210, there are preferably 72 planar regions 311, including 60 hexagonal regions 311A and 12 pentagonal regions 311B. A raised seam 313 extends generally around a circumference of the ball 310 between borders of a portion of the planar regions 311. A plurality of concave divots 314 are formed in the outer surface 312. The shape of the divots 314 generally corresponds to the shape of the planar regions 311 in which they are formed. For example, hexagonal divots 314A are formed in the hexagonal regions 311A and pentagonal divots 314B are formed in the pentagonal regions 311B.

In the depicted embodiment, one divot 314 is generally centered in each of the planar regions 311. Alternately, divots could be selectively omitted from some planar regions 311. For example, divots could be omitted from some or all of the pentagonal regions 311B. Additionally, the divots could be made larger or smaller. For example, each divot could extend almost to the intersections with adjacent regions. Divots could also be located off center and/or extend onto more than one planar region.

Unlike the divots 214, which have a slopping transition from their respective regions 211, the divots 314 have a stepped transition from their respective regions 311, although the present invention is not necessarily limited to a particular transition type.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

What is claimed is:

1. A method of playing a baseball game, the method comprising:

throwing a plastic baseball, the plastic baseball including a hollow plastic shell, and an outer surface of the hollow plastic shell comprising a plurality of solid planar surfaces, each and every one of the plurality of solid planar surfaces directly adjoining multiple adjacent ones of the plurality of solid planar surfaces, the directly adjoining multiple adjacent ones of the plurality of solid planar surfaces defining a repeating pattern comprising a pentagon-shaped solid planar surface surrounded by hexagon-shaped solid planar surfaces, the outer surface comprising a raised seam extending at boundaries between the directly adjoining ones of the plurality of solid planar surfaces, and extending completely across a given boundary segment between two adjoining ones of the plurality of solid planar surfaces and extending completely through at least one adjacent boundary segment between two adjoining ones of the plurality of solid planar surfaces;

wherein the throwing of the plastic baseball includes imparting a spin thereto such that the plastic baseball curves during flight; and wherein the plastic baseball is thrown with spin such that the plastic baseball rises during the flight as a result of the spin.

2. The method of claim 1, wherein each and every one of the plurality of solid planar surfaces is directly adjoined by at least another four of the plurality of solid planar surfaces.

3. The method of claim 2, wherein a number of the plurality of solid planar surfaces is more than 50.

4. The method of claim 1, wherein the plastic baseball is thrown toward a batter.

5. The method of claim 1, wherein the repeating pattern comprises a single pentagon-shaped solid planar surface surrounded by five hexagon-shaped solid planar surfaces.

* * * * *